US005685732A

United States Patent [19]

Lane

[11] Patent Number: 5,685,732

[45] Date of Patent: Nov. 11, 1997

[54] ADJUSTABLE EXTENSION CORD RETAINING DEVICE PREVENTING ACCIDENTAL DISENGAGEMENT OF MALE TO FEMALE ADAPTOR PLUGS

[75] Inventor: Arlo Lane, Reading, Mich.

[73] Assignee: Invo Marketing & Sales, Inc., Coldwater, Mich.

[21] Appl. No.: 719,288

[22] Filed: Sep. 26, 1996

[51] Int. Cl.[6] ..... H01R 13/62

[52] U.S. Cl. ..... 439/369; 24/523; 439/370

[58] Field of Search ..... 439/369, 370; 24/523

[56] References Cited

U.S. PATENT DOCUMENTS

| | | | |
|---|---|---|---|
| 1,266,776 | 5/1918 | Dietzel | 24/523 |
| 4,319,800 | 3/1982 | Bernat | 439/686 |
| 4,515,423 | 5/1985 | Moore et al. | 439/502 |
| 4,875,874 | 10/1989 | Windsor, Jr. | 439/369 |
| 4,907,984 | 3/1990 | Keller | 439/369 |
| 4,907,985 | 3/1990 | Johnsen | 439/369 |
| 4,917,625 | 4/1990 | Haile | 439/358 |
| 5,129,839 | 7/1992 | Vanskiver | 439/367 |
| 5,166,995 | 11/1992 | Briggs et al. | 385/58 |
| 5,179,044 | 1/1993 | Muromachi et al. | 439/369 |
| 5,395,264 | 3/1995 | Keith | 439/502 |
| 5,454,728 | 10/1995 | Jack | 439/277 |

FOREIGN PATENT DOCUMENTS

| | | | |
|---|---|---|---|
| 0818717 | 7/1969 | Canada | 439/369 |

*Primary Examiner*—Neil Abrams
*Assistant Examiner*—T. C. Patel
*Attorney, Agent, or Firm*—Gifford, Krass, Groh, Sprinkle, Patmore, Anderson & Citkowski, P.C.

[57] ABSTRACT

An extension cord retaining device for preventing accidental disengagement of male and female extension cord adapters. A first planar shaped member includes a flattened body portion and a first pair of angularly extending and spaced apart gripping members. A second planar shaped member includes a pair of spaced apart and axially extending legs which receive the flattened body portion of the first planar member in a coplanar fashion and a second pair of angularly extending and spaced apart gripping members which are arranged opposite the first pair of gripping members. An upper plate and a lower plate sandwich the first and second planar shaped members and fasteners secure the stacked arrangement together. The arrangement of the first and second planar shaped members is such that the first member is axially slidable relative to the second member and a coil spring is further employed to introduce an inward resilient bias to the opposing pairs of gripping portions to maintain contact with the male and female adapters.

4 Claims, 1 Drawing Sheet

ADJUSTABLE EXTENSION CORD RETAINING DEVICE PREVENTING ACCIDENTAL DISENGAGEMENT OF MALE TO FEMALE ADAPTOR PLUGS

BACKGROUND OF THE INVENTION

1. Field of the Invention

The present invention relates generally to retaining and securing devices for holding together male to female extension cord plug attachments and, more particularly, to an adjustable and inwardly resiliently biased extension cord retaining device for securing together a male to female adapter plug connection.

2. Description of the Prior Art

The prior art is well documented with connecting devices for the specific purpose of retaining the connection established between conventional male and female extension cord adapter plugs. Such devices are particularly useful when one or more extension cords are employed to make possible the operation of an electrically powered device at a considerable distance from an electrical outlet while helping to prevent accidental disengagement of the male to female connections.

U.S. Pat. No. 5,129,839, issued to VanSkiver, discloses an extension cord connection housing for encapsulating a male to female plug connection and which includes an upper housing half and a lower housing half which are hingedly connected together along one side. A latch mechanism is provided for selectively engaging and disengaging the housing around the male/female connection. Pluralities of angled teeth are arrayed on opposing inner sides of the housing and cooperate with a ratcheting mechanism which includes an internally travelling plug retaining bracket to resistively maintain the male and female adapters in their arrangement.

While providing an effective adapter plug connection housing, the device of VanSkiver requires the use of a fairly complex number of elements and, upon breakage of any of these elements, would become unusable. In spite of the ratchet mechanism and travelling plug bracket, the housing of the VanSkiver device is still fairly limited to only encapsulating adapter plugs according to the most conventional dimensions and would likely not be well suited for securing together plugs having shapes and configurations which are too different from the ordinary.

Additional adapter plug connection devices are disclosed in references such as U.S. Pat. No. 5,179,044, issued to Muromachi et al., and U.S. Pat. No. 5,505,634, issued to Osten. Muromachi teaches an elongated and elastic strap-like member which cooperates with the adapter connection and wraps around the male and female adapter plugs to bias them together. Osten teaches two one-piece receptacle like members having their side walls formed with conical threads and threadably secured together to encapsulate the male and female plugs together. In each instance, the above references suffer from the shortcomings of being fairly complex in that they utilize a number of structural features and again in that they are effective when used with only a limited number of differently configured adapter plugs.

U.S. Pat. No. 4,875,874, issued to Windsor, Jr., discloses an electrical connector arrangement which utilizes a rotating latch member incorporated into a female plug adapter which is seatingly engaged within an aperture formed in a corresponding male plug. The main shortcoming of the Windsor, Jr. device is that it requires that the extension cords be integrally formed with the male and female latch members and, accordingly, does not suggest the use of a device with conventional extension cords.

Finally, U.S. Pat. No. 4,917,625, issued to Haile, discloses an intermediate engaging electrical connector having springable arms extending from first and second ends to define first and second ports. The male and female plug adapters are engaged between the spring-like arms extending from the ends of the connector and the arms further include inwardly contoured shoulders which engage annular edges of the plugs and prevent accidental disengagement.

The device of Haile relies upon a basically standardized shape of the male and female adapters and further requires that the outwardly formed annular lip be present on each adapter, identified as element 33 in its drawings, to provide abutting contact with the shoulders of the spring arms. The device of Haile is therefore not well suited for use with male and female adapter plugs having different shapes and configurations.

SUMMARY OF THE PRESENT INVENTION

The present invention is an improved extension cord retaining device for providing inwardly-biasing engagement and for preventing accidental disengagement of male to female adapter plug connections according to a widely varying range of sizes and configurations. The retaining device has a body which includes first and second substantially planar-shaped members which terminate at opposite ends in respective first and second pairs of angularly extending and spaced apart gripping portions.

The first and second planar-shaped members are slidably connected together so that the pairs of gripping portions may be axially adjusted in directions towards and away from each other to engage the male and female adapter plugs once they have been operatively connected together. According to a preferred embodiment, the first and second planar-shaped members are configured so that they assemble in a substantially coplanar fashion and are sandwiched between an upper plate and a lower plate.

The first planar-shaped member is resiliently biased in a direction towards the second planar-shaped member by a coil spring which is placed axially within a slotted portion formed in the first planar-shaped member. Each of the upper and lower plates have channeled recesses which align above and below the slotted portion, the ends of the recesses providing shoulders against which the associated ends of the coil spring engage to resiliently bias the first planar-shaped member towards the second planar-shaped member.

Threaded mounting bolts are rotatably engaged through internally threaded apertures in the sandwiched plate arrangement to secure the retaining device together. According to a further preferred embodiment, the second planar-shaped member is configured with additional slotted portions at an end associated with a pair of the mounting bolts. The bolts may be loosened and successively retightened so that the second pair of angularly extending gripping members may be adjusted inwardly and outwardly an additional predetermined axial distance. The construction of the improved retaining device is such that it is capable of engaging male and female outlet plugs according to a wide variety of shapes and configurations.

BRIEF DESCRIPTION OF THE DRAWING

Reference will now be made to the attached drawing, when read in combination with the following specification, wherein like reference numerals refer to like parts throughout the several views, and in which:

FIG. 5 is an exploded view of the extension cord retaining device according to a further preferred embodiment of the present invention and illustrating an additional pairs of slotted portions formed along the second planar shaped member for permitting the second pair of spaced apart gripping portions an additional limited degree of axial adjustment.

DESCRIPTION OF THE PREFERRED EMBODIMENTS

Figures 1, 2, 3, 4:
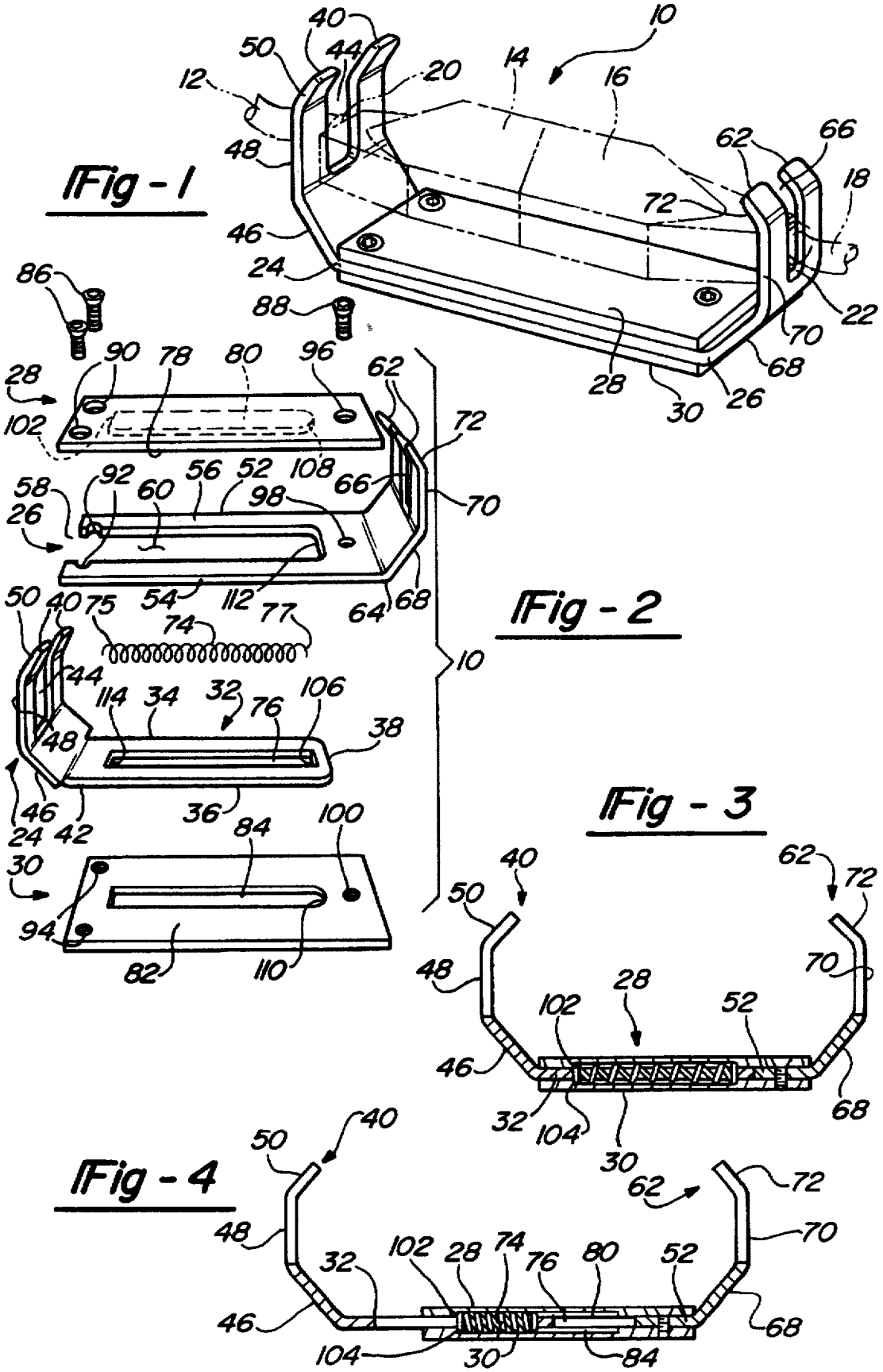
FIG. 1 is a perspective view of the extension cord retaining device according to a first preferred embodiment of the present invention and with the male and female adapter plugs and extension cords illustrated in phantom in an engaged fashion.
FIG. 2 is an exploded view of the extension cord retaining device according to the preferred embodiment of FIG. 1.
FIG. 3 is a side view, in partial cutaway, illustrating the first and second planar shaped members and opposing pairs of spaced apart gripping portions in a first, axially retracted position.
FIG. 4 is a side view, also in partial cutaway, similar to that shown in FIG. 3 and illustrating the planar shaped members and gripping portions in a second, axially extended and inwardly resiliently biased position.

With reference to FIG. 1, an improved extension cord retaining device 10 is shown for attaching to and preventing accidental disengagement between male and female adapter plugs of first and second extension cords. Shown in phantom is a first extension cord 12 with a male adapter plug 14 located at an end thereof which is operatively engaged to a female adapter plug 16 located at an end of a second extension cord 18. A substantially planar and outwardly facing engaging shoulder 20 is located between the first extension cord 12 and the male adapter plug 14 and a likewise substantially planar and outwardly facing engaging shoulder 22 is located between the second extension cord 18 and the female adapter plug 16. Also, while the plug 14 is identified as the male plug and the plug 16 as the female, it is understood that this arrangement can be reversed and that it has not effect on the applicability and use of the retaining device 10 as will now be described.

Referring again to FIG. 1, and also to FIG. 2, the extension cord retaining device 10 is shown in exploded view and includes a first planar shaped member 24 and a second planar shaped member 26 which are sandwiched between an upper plate 28 and a lower plate 30. The planar shaped members 24 and 26 as well as plates 28 and 30 are preferably constructed of a steel or similar metallic material but can also be a synthetic polymer or high impact resistant plastic or any other material exhibiting the necessary properties of relatively light weight and resiliency.

The first planar shaped member 24 includes a flattened body portion 32 defined by sides 34 and 36 and an inner end 38. A first pair of angularly extending and spaced apart gripping portions 40 extend in a substantially upwardly fashion from an outer end 42 of the first member 24 and define a channeled recess 44 therebetween. When viewed in side section, the gripping portions 40 include a first outwardly angled contour 46, a second substantially level and upwardly extending contour 48 and a third inwardly angled contour 50.

The second planar shaped member 26 likewise includes a flattened body portion 52 which is separated into a first axially extending leg 54 and a second axially extending leg 56 which terminate at an inner end 58 and which form an interior channel 60. A second pair of angularly extending and spaced apart gripping portions 62 extend in a substantially upwardly fashion from an outer end 64 of the second member 26 and define a channeled recess 66 therebetween. When viewed in side section, the gripping portions 62 include a first outwardly angled contour 68, a second substantially level and upwardly angled contour 70 and a third inwardly angled contour 72.

The flattened body portion 32 of the first member 24 may be located within the interior channel 60 defined between the axially extending legs 54 and 56 of the second member 26 so that the first and second members 24 and 26, upon assembly, form a continuous coplanar surface as illustrated in the assembled perspective view of FIG. 1 and the operative side views of FIGS. 3 and 4. Upon assembly of the planar shaped upper plate 28 and lower plate 30 in the sandwiching arrangement illustrated, the retaining device forms a smooth-contoured and axially slidable plate structure for accommodating male and female adapter plugs according to a variety of differing dimensions as will now be described.

Referring again to FIG. 2, a coil spring 74 is located centrally within the stacked arrangement of the retaining device 10 and is dimensioned such that it may be received within an axially extending slotted portion 76 formed centrally within the flattened body portion 32 of the first planar shaped member 24. An inner face 78 of the upper sandwiching plate 28 includes a channeled recess 80 and a corresponding inner face 82 of the lower sandwiching plate 30 includes a likewise channeled recess 84. The recesses 80 and 84 are of approximate length and width as compared to the slotted portion 76 of the first planar shaped member 24 and, upon assembly of the stacked arrangement, corresponding upper and lower portions of the coil spring 74 occupy the spaces of the channeled recesses 80 and 82.

Referring again to FIG. 2, a set of threaded mounting bolts are provided, indicated as a first pair of bolts 86 and a third bolt 88, for securing together the stacked arrangement of the retaining device. The first pair of bolts 86 insert through a corresponding first pair of counter-bored apertures 90 formed at an end of the upper plate 28, a pair of aligned and semi-circular recesses 92 formed along inner surfaces of the axially extending legs 54 and 56 of the second planar shaped member 26, and through another pair of threaded apertures 94 formed at a like end of the lower plate 30. The third bolt 88 likewise inserts through aligned apertures 96, 98 and 100 formed at opposing ends of the upper plate 28, second planar shaped member 26 and lower plate 30, respectively.

Upon assembly of the stacked arrangement of the retaining device, the coil spring 74 located within the slotted portion 76 and abutting within the upper and lower channel recesses 80 and 84, introduces a resilient and inwardly directed axial bias to encourage the first pair of gripping members 40 of the first planar member 24 in a direction towards the second pair of gripping member 62 of the second planar member 26 in response to an axially outward deflection as illustrated in FIG. 4. This is caused by an end 75 of the coil spring 74 abutting against end surfaces 102 and 104 of the upper and lower channeled recesses 80 and 84 with increased biasing upon an opposing end 77 of the spring 74 being axially compressed and displaced by an end surface 106 of the slotted portion 76 in a direction away from associated end surfaces 108 and 110 of the upper and lower channeled recesses. The effect of the outwardly biasing nature of the compressed coil spring 74 is to encourage the flattened plate shaped body portion 32 of the first planar member 24 in a direction along the interior channel 60 of the second planar member 26 until the end 38 is once again in abutting engagement with an opposing end wall 112 of the channel 60 (see FIG. 2) and the end 75 of the spring 74 is once again in contact with an associated opposing end 114 of the slotted portion, 76 at which point the retaining devices is in a fully retracted position as shown in FIG. 3.

In use, the pairs of angularly extending and spaced apart gripping portions 40 and 62 are axially deflected outwardly to the extent necessary to surround the male and female adapters 14 and 16. Specifically, the space 44 between the gripping portions 40 receives the extension cord 12 and the portions 40 abut against the outwardly facing engaging shoulder 20 of the male adapter. Likewise, the space 66 between the gripping portions 62 receives the extension cord 18 and the gripping portions 62 abut against the outwardly facing engaging shoulder 22 of the female adapter. In this fashion, the retaining device is quickly and efficiently mounted in a detachable fashion around the interconnected male and female adapters in the manner illustrated in FIG. 1 and in an adjustable and inwardly resiliently biased manner. The successive outward, planar and inward angled orientation of the gripping portions, when viewed in side section, assists in retaining a wide variety of adapter plug shapes. The retaining device is therefore capable of securing to male/female adapters according to a fairly wide variety of shapes and configurations.

Referring to FIG. 5, a further modification 10' of the extension cord retaining device according to the present invention is illustrated and incorporates a modification 26' of the second planar shaped member to permit an additional degree of axial adjustment capability to the second pair of gripping members 62' beyond the inwardly biased and axially slidable capabilities of the first planar shaped member 24 which are provided by the coil spring 74 and sliding plate arrangement. Specifically, the recesses 92 of the first preferred embodiment are lengthened considerably along the inner surfaces of axially extending legs 54' and 56' in order to form elongated slotted recesses 92'. Likewise, the aperture 98 at the opposing end is also elongated according to this embodiment to form a slot shape 98'.

When viewed in the embodiment of FIG. 5, and upon assembly of the stacked arrangement which makes up the retaining device, the gripping portions 62' of the second planar shaped member 26' may be additionally adjusted in an axial fashion independently of the operation of the coil spring and sliding plates, the arrangement and construction of which remains unchanged by this embodiment. All that it required to axially adjust the second member 26' is to rotate the screws or bolts 86 and 88 in a loosening direction, upon which the member 26' is readjusted to its desired position and the bolts retightened to resecure the members 24 and 26' in place. The modification of the second planar shaped member 26' therefore provides an additional axial adjustment to the sliding plate arrangement and can be substituted for the planar shaped member 26 according to the first preferred embodiment for use with the remaining members of the stacked arrangement.

It is therefore evident that the present invention provides an improved and more efficient retaining device for securing male and female adapter plugs against accidental disengagement during use. Additional embodiments will become apparent to those skilled in the art to which it pertains without deviating from the scope of the appended claims.

I claim:

1. An extension cord retaining device for preventing accidental disengagement of a male to female adapter plug connection, comprising:

a first substantially planar shaped member terminating at one end in a first pair of angularly extending and spaced apart gripping portions;

a second substantially planar shaped member terminating at another end in a second pair of angularly extending and spaced apart gripping portions which are arranged in opposing fashion relative to said first pair of gripping portions;

means for slidably connecting said first and second planar shaped members together so that at least one of said first pair of gripping portions and said second pair of gripping portions are capable of being axially adjustable in directions towards and away from each other, said first planar shaped member including a flattened body portion, said second planar shaped member including first and second axially extending and spaced apart legs which define therebetween an interior channel of sufficient dimension for receiving said flattened body portion of said first planar shaped member therebetween in an aligned and coplanar fashion, an upper plate and a lower plate sandwiching said first and second assembled and coplanar members and fasteners extending through aligned apertures at first and second ends in said upper and lower plates and said planar shaped members for securing said retaining device together, one of said first and second pairs of gripping portions being adjustable to engage a male adapter plug and the other of said pairs of gripping portions being adjustable to engage a female adapter plug connected to the mail adapter plug; and means for resiliently biasing said first planar shaped member in a direction towards said second planar shaped member so that the adapter plugs are retained in operative engagement.

2. The extension cord retaining device according to claim 1, said first and second pairs of angularly extending and spaced apart gripping portions extending beyond said upper and lower plates at opposite ends thereof and each further comprising:

a first outwardly angled contour;

a second substantially level and upwardly extending contour; a third inwardly angled contour, and a channeled recess between said gripping portions for receiving an associated extension cord and for permitting said gripping portions to abut against the adapter plugs.

3. The extension cord retaining device according to claim 1, said means for resiliently biasing said first planar shaped member in a direction towards said second planar shaped member further comprising:

an axially extending slotted portion formed within said flattened body portion of said first planar shaped member;

an upper channel recess formed within an inner face of said upper plate and a lower channel recess formed within a face of said lower plate, said channel recesses aligning with said slotted portion upon assembly of said retaining device; and a coil spring located axially within said extending slotted portion and, upon assembly of said upper plate and said lower plate, extending into said upper and lower channel recesses;

said coil spring introducing a reverse and biasing force in response to forces created by compressing said coil spring upon the axial displacement of said first planar shaped member away from said second planar shaped member.

4. The extension cord retaining device according to claim 1, said means for slidably connecting together said first and second planar shaped members further comprising:

a pair of elongated slotted recesses formed along inner surfaces of said axially extending and spaced apart legs of said second planar shaped member at said first end; and a slotted aperture formed along said second planar shaped member at said second end;

wherein, upon assembly of said first planar shaped member and said upper plate and lower plate, said second pair of gripping members is capable of an additional degree of axial adjustment upon loosening and subsequent retightening of said fasteners.

* * * * *

UNITED STATES PATENT AND TRADEMARK OFFICE

CERTIFICATE OF CORRECTION

PATENT NO. : 5,685,732
DATED : November 11, 1997
INVENTOR(S) : Arlo Lane

It is certified that error appears in the above-indentified patent and that said Letters Patent is hereby corrected as shown below:

Column 3, line 39, "not" should be --no--.
Column 5, line 3, "devices" should be --device--

Signed and Sealed this

Fifth Day of May, 1998

*Attest:*

*Attesting Officer*

BRUCE LEHMAN

*Commissioner of Patents and Trademarks*